US006732798B2

(12) United States Patent
Johnson et al.

(10) Patent No.: US 6,732,798 B2
(45) Date of Patent: May 11, 2004

(54) CONTROLLING TRANSIENT UNDERBALANCE IN A WELLBORE

(75) Inventors: Ashley B. Johnson, Cambridge (GB); Lawrence A. Behrmann, Houston, TX (US); Wenbo Yang, Sugar Land, TX (US); Fokko Harm Cornelis Doornbosch, Sola (NL)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/316,614

(22) Filed: Dec. 11, 2002

(65) Prior Publication Data

US 2003/0089498 A1 May 15, 2003

Related U.S. Application Data

(63) Continuation-in-part of application No. 09/797,209, filed on Mar. 1, 2001, which is a continuation-in-part of application No. 09/620,980, filed on Jul. 21, 2000.

(60) Provisional application No. 60/252,754, filed on Nov. 22, 2000, provisional application No. 60/187,900, filed on Mar. 8, 2000, and provisional application No. 60/186,500, filed on Mar. 2, 2000.

(51) Int. Cl.[7] ..... E21B 43/11

(52) U.S. Cl. ..... 166/297; 166/311; 166/55.1

(58) Field of Search ..... 166/55.1, 297, 166/311, 370, 163

(56) References Cited

U.S. PATENT DOCUMENTS

| | | | | |
|---|---|---|---|---|
| 4,175,042 A | | 11/1979 | Mondshine | |
| 4,650,010 A | | 3/1987 | George et al. | |
| 4,862,964 A | * | 9/1989 | George et al. | 166/297 |
| 5,551,344 A | * | 9/1996 | Couet et al. | 102/312 |
| 5,635,636 A | | 6/1997 | Alexander | |
| 6,173,783 B1 | | 1/2001 | Abbott-Brown et al. | |
| 6,394,184 B2 | * | 5/2002 | Tolman et al. | 166/281 |

FOREIGN PATENT DOCUMENTS

| | | |
|---|---|---|
| WO | WO 99/42696 | 8/1999 |
| WO | WO 01/25595 A1 | 4/2001 |

OTHER PUBLICATIONS

Scott, Wu and Bridges, "Air Foam Improves Efficiency of Completion and Workover Operations in Low–Pressure Gas Wells", SPE 27922, Dec., 1995, pp. 219–225.

* cited by examiner

*Primary Examiner*—David Bagnell
*Assistant Examiner*—Jennifer R. Dougherty
(74) *Attorney, Agent, or Firm*—Trop, Pruner & Hu PC; Jeffrey Griffin; Brigitte Jeffery Echols

(57) ABSTRACT

A method and apparatus for controlling a transient underbalance condition is provided. Transient underbalance can be enhanced by using a porous material, such as a porous solid, around the explosive device. The porous material contains a volume to receive wellbore fluids in response to activation of the explosive device. This causes a local drop in pressure, which enhances the transient underbalance effect. In another application, it is desired to reduce the transient underbalance effect. This is accomplished by reducing the pressure drop generated as a result of explosive detonation. In one arrangement, the shot density is reduced by using solid masses.

28 Claims, 14 Drawing Sheets

CONTROLLING TRANSIENT UNDERBALANCE IN A WELLBORE

This is a continuation-in-part of U.S. Ser. No. 09/797,209, filed Mar. 1, 2001, which claims the benefit of U.S. Provisional Application Serial Nos. 60/186,500, filed Mar. 2, 2000; 60/187,900, filed Mar. 8, 2000; and 60/252,754, filed Nov. 22, 2000. This is also a continuation-in-part of U.S. Ser. No. 09/620,980, filed Jul. 21, 2000.

TECHNICAL FIELD

The invention relates generally to improving reservoir communication within a wellbore.

BACKGROUND

To complete a well, one or more formation zones adjacent a wellbore are perforated to allow fluid from the formation zones to flow into the well for production to the surface or to allow injection fluids to be applied into the formation zones. A perforating gun string may be lowered into the well and the guns fired to create openings in casing and to extend perforations into the surrounding formation.

The explosive nature of the formation of perforation tunnels shatters sand grains of the formation. A layer of "shock damaged region" having a permeability lower than that of the virgin formation matrix may be formed around each perforation tunnel. The process may also generate a tunnel full of rock debris mixed in with the perforator charge debris. The extent of the damage, and the amount of loose debris in the tunnel, may be dictated by a variety of factors including formation properties, explosive charge properties, pressure conditions, fluid properties, and so forth. The shock damaged region and loose debris in the perforation tunnels may impair the productivity of production wells or the injectivity of injector wells.

One popular method of obtaining clean perforations is underbalanced perforating. The perforation is carried out with a lower wellbore pressure than the formation pressure. The pressure equalization is achieved by fluid flow from the formation and into the wellbore. This fluid flow carries some of the damaging rock particles. However, underbalance perforating may not always be effective and may be expensive and unsafe to implement in certain downhole conditions.

Fracturing of the formation to bypass the damaged and plugged perforation may be another option. However, fracturing is a relatively expensive operation. Moreover, clean, undamaged perforations are required for low fracture initiation pressure (one of the pre-conditions for a good fracturing job). Acidizing, another widely used method for removing perforation damage, is not effective for treating sand and loose debris left inside the perforation tunnel.

A need thus continues to exist for a method and apparatus to improve fluid communication with reservoirs in formations of a well.

SUMMARY

In general, according to one embodiment, a method of controlling an underbalance condition in a wellbore includes configuring a perforating gun string according to a target transient underbalance condition in a perforating interval, and generating substantially the target transient underbalance condition in the perforating interval of the wellbore when the perforating gun string is shot.

Other or alternative features will become apparent from the following description, from the drawings, and from the claims.

DETAILED DESCRIPTION

Figure 1:
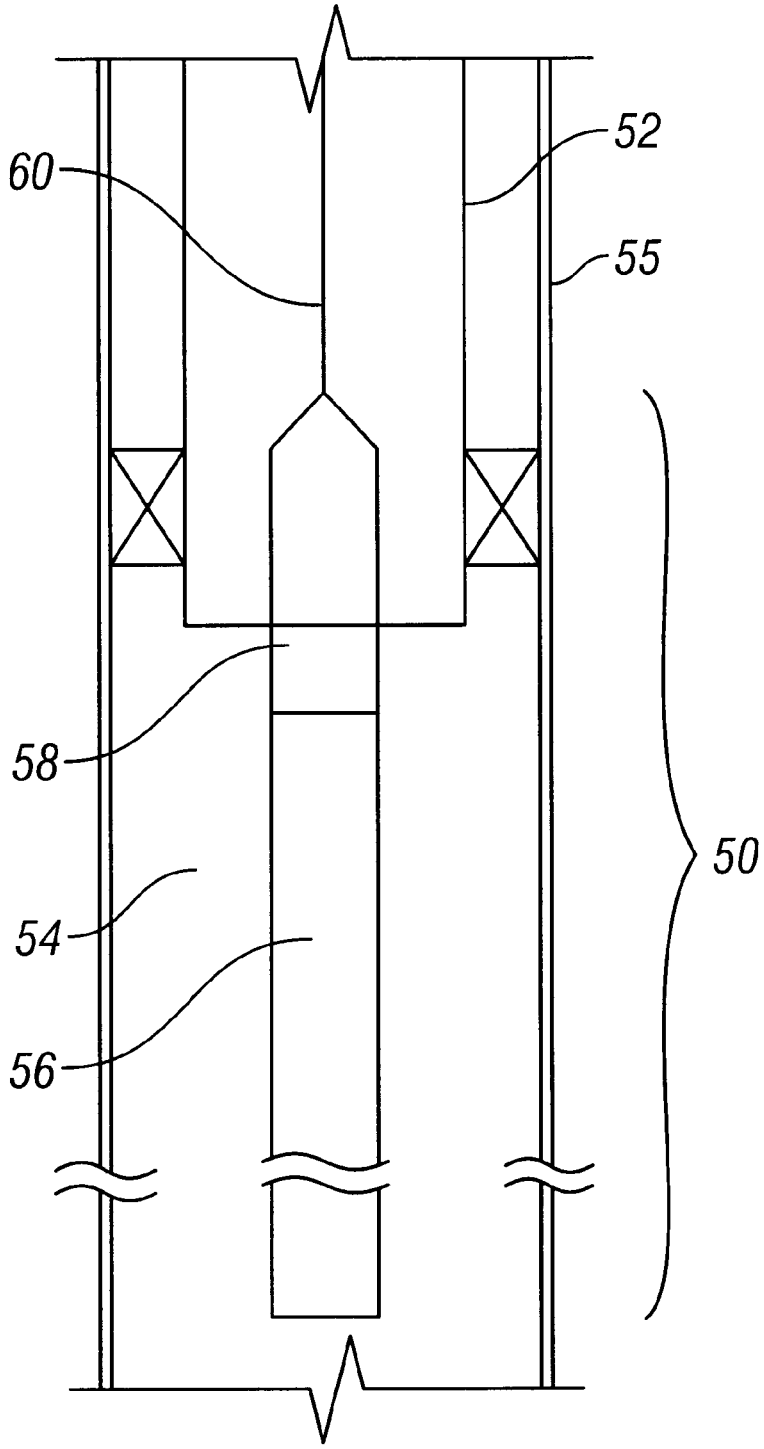
FIG. 1 illustrates an embodiment of a gun string positioned in a wellbore and including a gun system according to one of several embodiments.

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and "downwardly"; "upstream" and "downstream"; "above" and "below" and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Generally, mechanisms are provided for controlling a local, transient pressure condition in a wellbore. In some cases, it is desirable to lower the local pressure condition to enhance transient underbalance during a wellbore operation (e.g., perforation). Treatment of perforation damage and removal of perforation generated (charge and formation) debris from the perforation tunnels can be accomplished by increasing the local pressure drop (increasing the local transient underbalance). In other cases, it is desirable to reduce transient underbalance by reducing the amount of transient pressure drop during a wellbore operation.

In some embodiments, an assembly is provided to reduce (rather than enhance) the transient underbalance condition. A tool containing explosive components, such as a perforating gun, is activated in a wellbore environment having a certain pressure (e.g., pressure of an adjacent reservoir). Usually, detonation of explosive components generates gas that is at a pressure lower than the wellbore pressure, which tends to transiently reduce the local wellbore pressure (and thereby enhance the underbalance condition). To counteract this effect, the number of explosive components in the tool are reduced (e.g., by reducing shot density of a perforating gun). The space that would have been occupied by the explosive components in the tool are replaced with solid masses. As a result, the transient pressure drop due to activation of explosive components in a tool is reduced to reduce the transient underbalance.

In other embodiments, to enhance transient underbalance, a porous material, such as a porous solid, is provided around a tool (such as a perforating gun or other tool that contains explosives). Initially, the porous solid contains sealed volumes (that contain gas, light liquids, or a vacuum). When the explosives are detonated, the porous solid is crushed or broken apart such that the volumes are exposed to the wellbore. This effectively creates a new volume into which wellbore fluids can flow into, which creates a local, transient pressure drop. As a result, a transient underbalance condition is enhanced by use of a porous solid.

In yet further embodiments, a local low pressure drop is enhanced by use of a chamber containing a relatively low fluid pressure. For example, the chamber is a sealed chamber containing a gas or other fluid at a lower pressure than the surrounding wellbore environment. As a result, when the chamber is opened, a sudden surge of fluid flows into the lower pressure chamber to create the local low pressure condition in a wellbore region in communication with the chamber after the chamber is opened.

The chamber can be a closed chamber that is defined in part by a closure member located below the surface of the well. In other words, the closed chamber does not extend all the way to the well surface. For example, the closure member may be a valve located downhole. Alternatively, the closure member includes a sealed container having ports that include elements that can be shattered by some mechanism (such as by the use of explosive or some other mechanism). The closure member may be other types of devices in other embodiments.

In operation, a well operator identifies or determines a target transient underbalance condition that is desired in a wellbore interval relative to a wellbore pressure (which may be set by reservoir pressure). The target transient underbalance condition can be identified in one of several ways, such as based on empirical data from previous well operations or on simulations performed with modeling software.

Based on the target transient underbalance, the tool string (e.g., perforating gun string) is configured. For example, an appropriate amount of porous material, such as a porous solid, is provided with the tool string to achieve the target transient underbalance condition. Again, the "appropriate" amount of the porous material can be based on empirical data from previous operations or from software modeling and simulations. In other cases, if the target transient underbalance condition indicates that reduction of a transient underbalance is desired, then the number of explosive components in the tool string is reduced. Determining the amount of porous material to use can be determined by software that is executable in a system, such as a computer system. The software is executable on one or more processors in the system. Similarly, the software is also able to determine how much reduction in the number of explosive components is needed to achieve the target reduction in the transient underbalance.

The configured control tool string is then lowered to a wellbore interval, where the tool string is activated to detonate explosives in the tool string. Activation causes substantially the target transient underbalance condition to be achieved.

Referring to FIG. 1, a perforating gun string 50 according to one embodiment is positioned in a wellbore. The perforating gun string 50 is designed to pass through a tubing 52 that is positioned in a wellbore 54 lined with casing 55. In another embodiment, the tubing 52 is not present. The perforating gun string 50 includes a perforating gun system 56 in accordance with various embodiments. The perforating gun system 56 may be attached to an adapter 58 that is in turn connected to a carrier line 60 for carrying the perforating gun string 50 into the wellbore 54. The carrier line 60 may include a wireline, a slickline, or coiled tubing, as examples. The several embodiments of the gun system 56 are described below. Even though the illustrated guns include shaped charges mounted in a phased manner, such phasing is not necessary.

The gun system 56 is provided with a porous solid so that, upon firing of the gun system 56, the sealed volume of the porous solid is exposed to the wellbore pressure to transiently decrease the wellbore pressure to enhance the local underbalance condition.

Figure 2A:
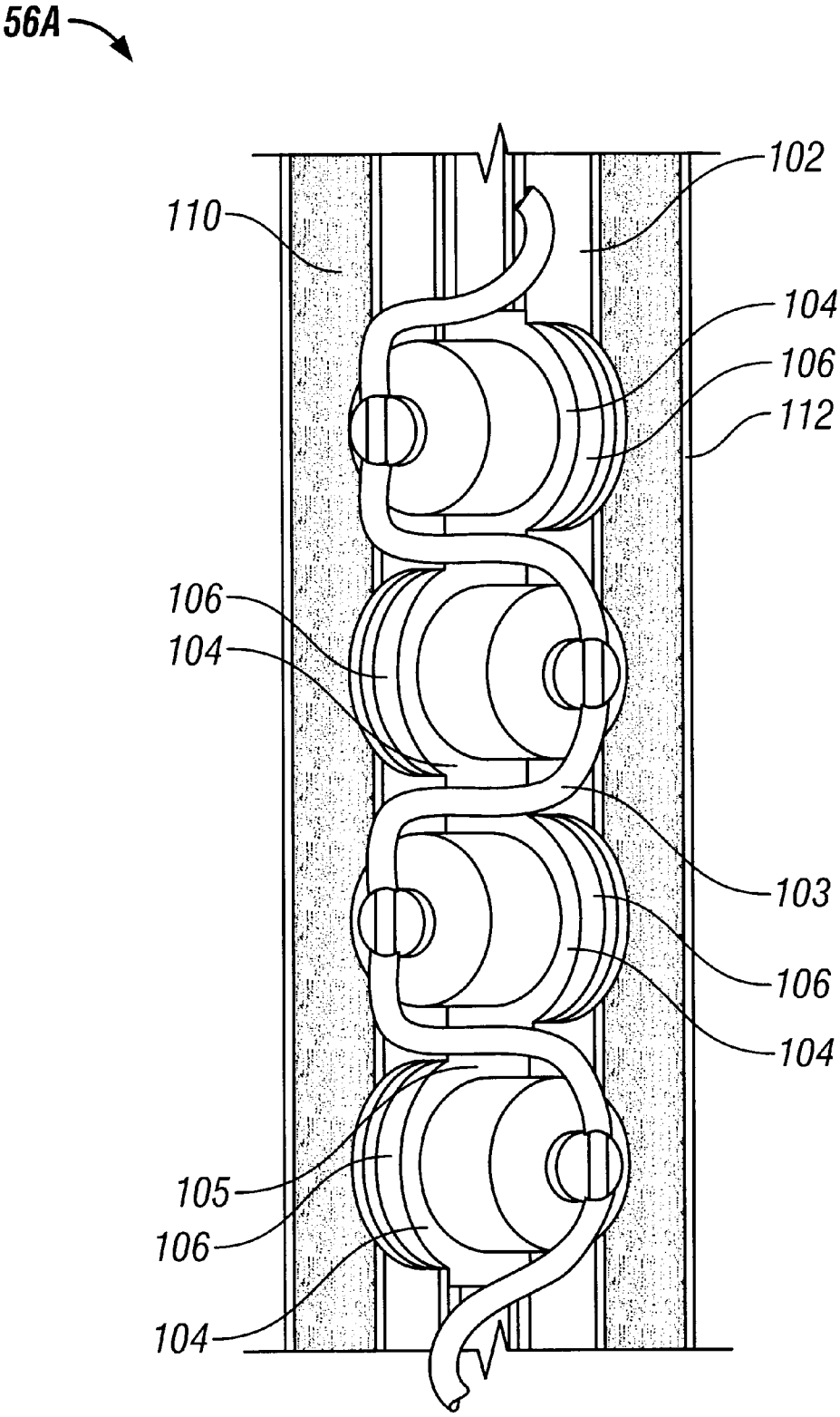
FIGS. 2A–2C illustrate perforating gun systems each including an encapsulant formed of a porous material.
Figure 2B:
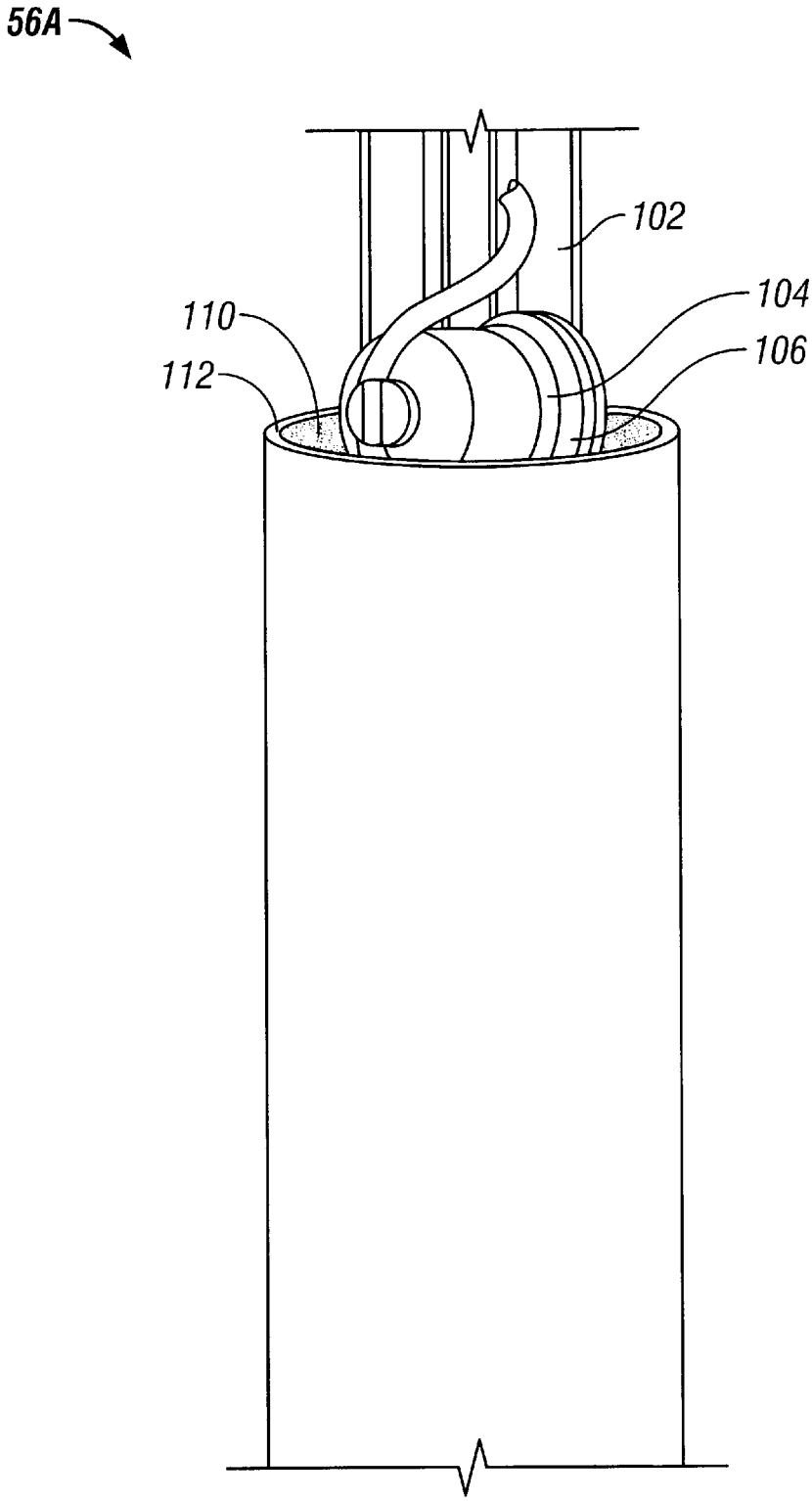

Referring to FIGS. 2A–2B, a perforating gun system 56A in accordance with one embodiment includes a linear strip 102 to which plural capsule shaped charges 106 are coupled. A detonating cord 103 is connected to each of the shaped charges 106. The shaped charges 106 are mounted in corresponding support rings 104 of a support bracket 105. The support bracket 105 may be twisted to provide a desired phasing (e.g., 45° spiral, 60° spiral, tri-phase, etc.). Alternatively, the support bracket 105 may be arranged in a non-phased pattern (e.g., 0° phasing). In another arrangement, the linear strip 102 may be omitted, with the support bracket 505 providing the primary support for the capsule charges 106.

In one embodiment, the carrier strip 102, support bracket 105, support rings 104, detonating cord 103 and capsule charges 106 are encapsulated in a porous material 110. One example of the porous material includes a porous solid such as porous cement. An example of a porous cement includes LITECRETE™. Porous cement is formed by mixing the cement with hollow structures, such as microspheres filled with a gas (e.g., air) or other types of gas- or vacuum-filled spheres or shells. Microspheres are generally thin-walled glass shells with a relatively large portion being air.

Porous cement is one example of a porous solid containing a sealed volume. When the gas-filled or vacuum-filled hidden structures are broken in response to detonation of the shaped charges 106, additional volume is added to the wellbore, thereby temporarily reducing pressure.

To provide structural support for the encapsulant 110, a sleeve 112 is provided around the encapsulant 110. The sleeve 112 is formed of any type of material that is able to provide structural support, such as plastic, metal, elastomer, and so forth. The sleeve 112 is also designed to protect the encapsulant 110 as the gun system 56A is run into the wellbore and it collides with other downhole structures. Alternatively, instead of a separate sleeve, a coating may be added to the outer surface of the encapsulant 110. The coating adheres to the encapsulant as it is being applied. The coating may be formed of a material selected to reduce fluid penetration. The material may also have a low friction.

In further embodiments, to provide higher pressure ratings, the encapsulant 110 may be formed using another type of material. For example, higher-pressure rated cement with S60 microspheres made by 3M Corporation may be used. As an alternative, the encapsulant 110 may be an epoxy (e.g., polyurethane) mixed with microspheres or other types of gas- or vacuum-filled spheres or shells. In yet a further embodiment, the encapsulant 110 can have plural layers. For example, one layer can be formed of porous cement, while another layer can be formed of porous epoxy or other porous solid. Alternatively, the encapsulant 110 can be a liquid or gel-based material, with the sleeve 112 providing a sealed container for the encapsulant 110.

In some embodiments, the porous material is a composite material, including a hollow filler material (for porosity), a heavy powder (for density), and a binder/matrix. The binder/matrix may be a liquid, solid, or gel. Examples of solid binder/matrix materials include polymer (e.g., castable thermoset such as epoxy, rubber, etc., or an injection/moldable thermoplastic), a chemically-bonded ceramic (e.g., a cement-based compound), a metal, or a highly compressible elastomer. A non-solid binder/matrix material includes a gel (which is more shock compressible than a solid) or a liquid. The hollow filler for the shock impeding material may be a fine powder, with each particle including an outer shell that surrounds a volume of gas or vacuum. In one example embodiment, the hollow filler can include up to about 60% by volume of the total compound volume, with each hollow filler particle including 70%–80% by volume air. The shell of the hollow filler is impermeable and of high strength to prevent collapse at typical wellbore pressures (on the order of about 10 kpsi in one example). An alternative to use of hollow fillers is to produce and maintain stable air bubbles directly within the matrix via mixing, surfactants, and the like.

In one example embodiment, the heavy filler powder can be up to 50% by volume of the total compound volume, with the powder being a metal such as copper, iron, tungsten, or any other high-density material. Alternatively, the heavy filler can be sand. In other embodiments, the heavy powder can be up to about 10%, 25% or 40% by volume of the total compound volume. The shape of the high-density powder particles is selected to produce the correct mix rheology to achieve a uniform (segregation-free) final compound.

Using sand as the heavy filler instead of metal provides one or more advantages. For example, sand is familiar to field personnel and thus is more easily manageable. In addition, by increasing the volume of sand, the volume of matrix/binder is decreased, which reduces the amount of debris made up of the matrix/binder after detonation.

In some examples, the bulk density of the shock absorbing material ranges from about 0.5 g/cc (grams per cubic centimeter) to about 10 g/cc, with a porosity of the compound ranging from between about 2% to 90%.

Other example porous solids include a 10 g/cc, 40% porous material, such as tungsten powder mixed with hollow microspheres, 50% each by volume. Another example compound includes 53% by volume low-viscosity epoxy, 42% by volume hollow glass spheres, and 5% by volume copper powder. The compound density is about 1.3 g/cc and the porosity is about 33%. Another compound includes about 39% by volume water, 21% by volume Lehigh Class H cement, 40% by volume glass spheres, and trace additives to optimize rheology and cure rate. The density of this compound is about 1.3 g/cc and the porosity is about 30%.

To form the encapsulant 110, the porous material (in liquid or slurry form) may be poured around the carrier strip 102 contained inside the sleeve 112. The porous material is then allowed to harden. With porous cement, cement in powder form may be mixed with water and other additives to form a cement slurry. During mixing of the cement, microspheres are added to the mixture. The mixture, still in slurry form, is then poured inside the sleeve 112 and allowed to harden. The equipment used for creating the desired mixture can be any conventional cement mixing equipment. Fibers (e.g., glass fibers, carbon fibers, etc.) can also be added to increase the strength of the encapsulant.

The encapsulant 110 can also be premolded. For example, the encapsulant can be divided into two sections, with appropriate contours molded into the inner surfaces of the two sections to receive a gun or one or more charges. The gun can then be placed between the two sections which are fastened together to provide the encapsulant 110 shown in FIG. 2B. In yet another example, the porous material may be molded to the shape in between two charges and loaded when the charges are loaded.

Figure 2C:
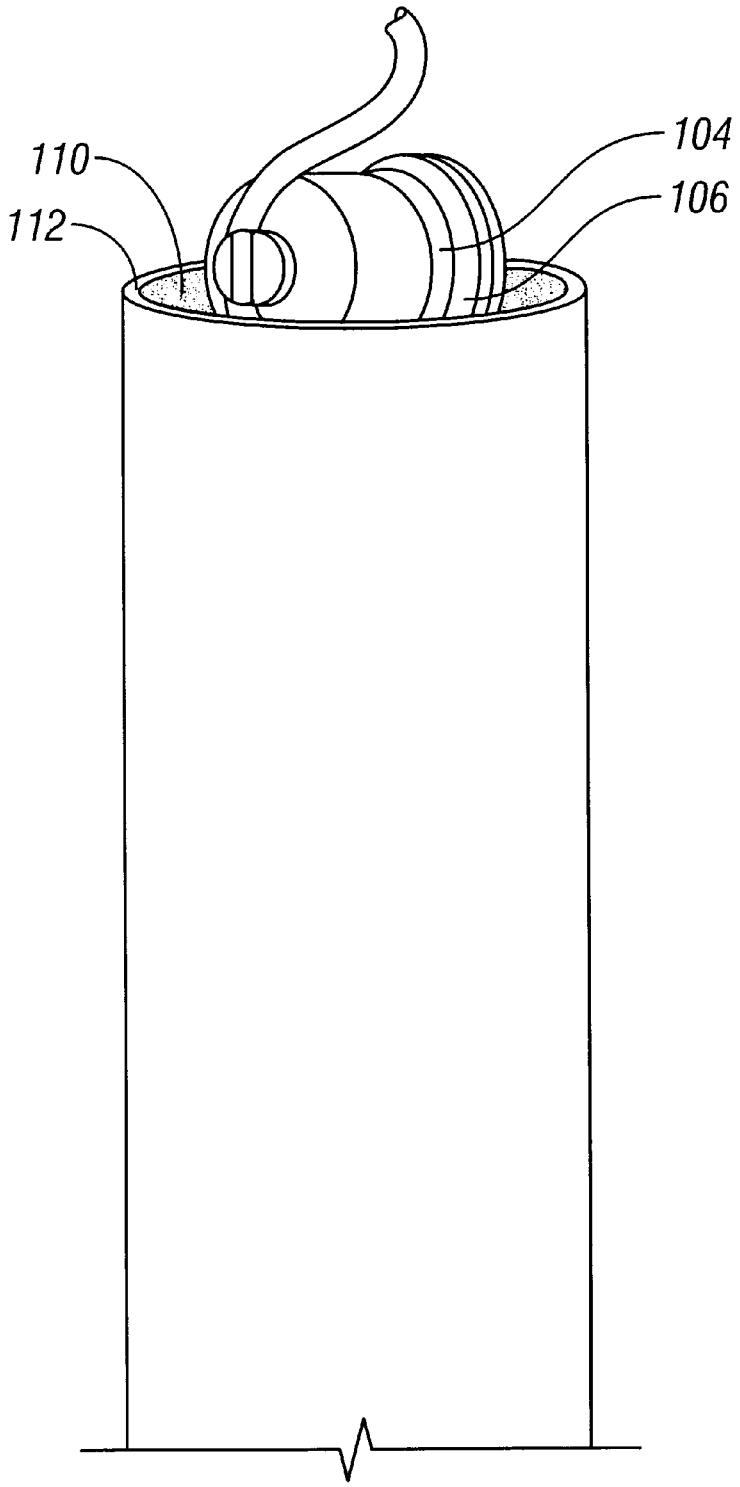

In another embodiment, as shown in FIG. 2C, the linear strip 102 is omitted, with the support bracket 105 and encapsulant 110 providing the needed support.

Figure 3A:
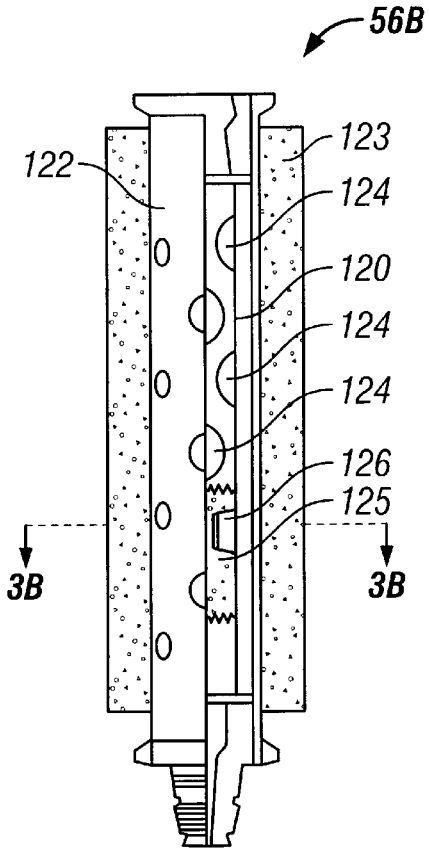
FIGS. 3A–3B illustrate a hollow gun carrier in accordance with another embodiment that includes a loading tube in which shaped charges are mounted, with the loading tube filled with a porous material.
Figure 3B:
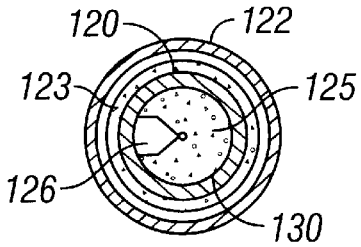

Referring to FIGS. 3A–3B, in accordance with another embodiment, instead of the carrier strip 102 shown in FIG. 2, a similar concept may be extended to a hollow carrier gun 56B. In the hollow carrier gun 56B, a loading tube 120 is positioned inside a hollow carrier 122. The loading tube 120 provides openings 124 through which shaped charges 126 may face. The shaped charges 126 may be non-capsule charges since the shaped charges are protected from the environment by the hollow carrier 122, which is typically sealed. After the shaped charges 126 are mounted inside the loading tube 120 during assembly, a porous material (e.g., porous cement) that is initially in liquid or slurry form may be poured through the top or bottom opening 130 of the loading tube. The material is then allowed to solidify to provide a porous material filler 125 inside the loading tube 120. FIG. 3B shows a cross-section of the gun 56B.

The porous material filler can also fill the inside of the hollow carrier 122 to provide a larger volume. In addition to enhancing the local transient underbalance condition, a further benefit of the porous material is that it is an energy absorber that reduces charge-to-charge interference. Also, the porous material may provide structural support for the hollow carrier so that a thinner-walled hollow carrier can be used. The porous material provides support inside the hollow carriers against forces generated due to wellbore pressures. With thinner hollow carriers, a lighter weight perforating gun is provided that makes handling and operation more convenient. A layer 123 formed of a porous material can also be provided around the external surface of the hollow carrier 122. The combination of the porous material inside and outside the hollow carrier 122 to provides a volume to receive wellbore fluids upon detonation.

Figure 4:
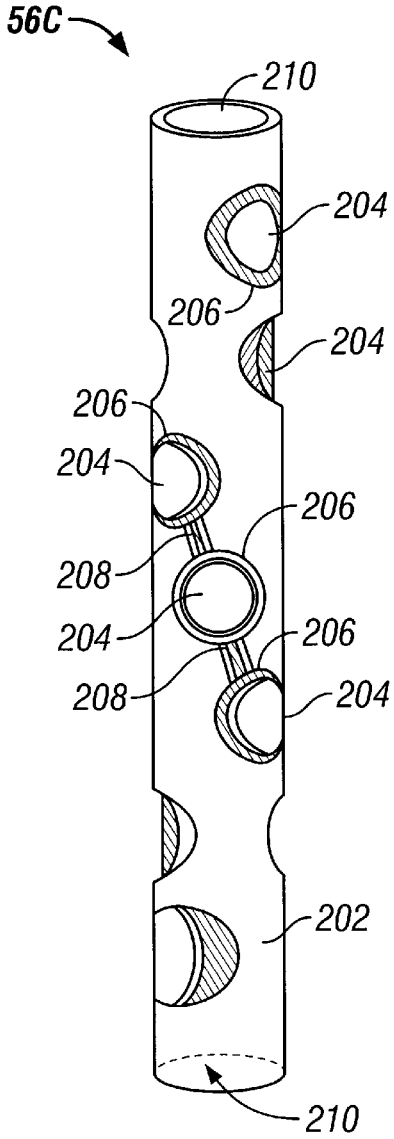
FIG. 4 illustrates a gun system according to a further embodiment that includes a carrying tube containing shaped charges and a porous material.

Referring to FIG. 4, in accordance with yet another embodiment, a perforating gun system 56C includes a tubular carrier 202 that may be used to carry capsule charges 204 mounted proximal openings 206 in the tubular carrier 202. The tubular carrier 202 may be arranged in a manner similar to the loading tube 120 of the hollow carrier gun 56B, except that the tubular carrier 202 is not contained inside a hollow carrier. As a result, capsule charges 204 are used instead of the non-capsule charges 106 of FIG. 3A. In one arrangement, a detonating cord 208 may be run along the exterior of the tubular carrier 202 and connected to the capsule charges 206. In another arrangement, the detonating cord 208 may be run inside the tubular carrier 202. As with the loading tube 120 of FIG. 3A, a porous material (e.g., porous cement) that is originally in liquid or slurry form may be poured through a top or bottom opening 210 of the tubular carrier 202. The porous material solidifies inside the tubular carrier 202 to form the porous material for shock and interference reduction. An advantage of using the tubular carrier 202 is that damage to the porous material is less likely because it is protected by the tubular carrier 206, which is typically a sturdy and rigid structure.

Figure 5A:
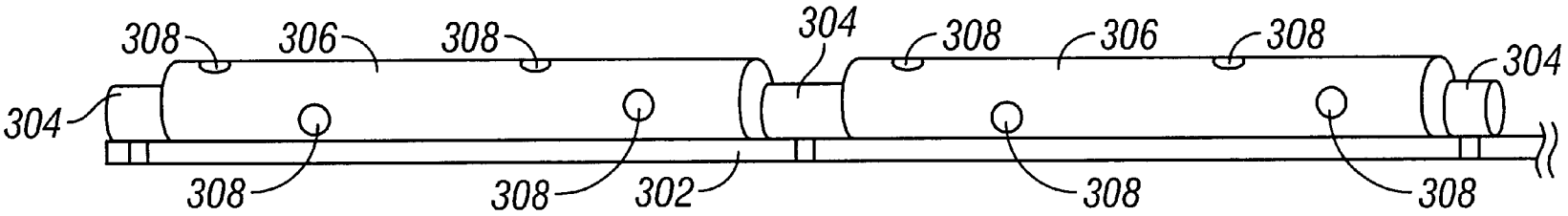
FIGS. 5A–5D illustrate gun systems according to yet other embodiments.

Referring to FIG. 5A, in accordance with yet another embodiment, a strip gun 56F includes plural shaped charges arranged in a phased pattern (e.g., spiral, tri-phased, and so forth) on a linear strip 302. Alternatively, a non-phased arrangement of the charges can be used. The 0°-phased shaped charges (referred to as 304) may be mounted directly to the strip 302. The other charges (not shown) are mounted inside tubes 306 attached to the strip 302. Openings 308 are provided in each tube 306 for corresponding shaped charges. A porous material, which may be one of the porous materials discussed above, is provided in each tube 306.

The tube 306 can be formed of a metal or other suitably rigid material. Alternatively, the tube 306 can also be formed of a porous material, such as a porous solid (e.g., porous cement, porous epoxy, etc.).

Figure 5B:
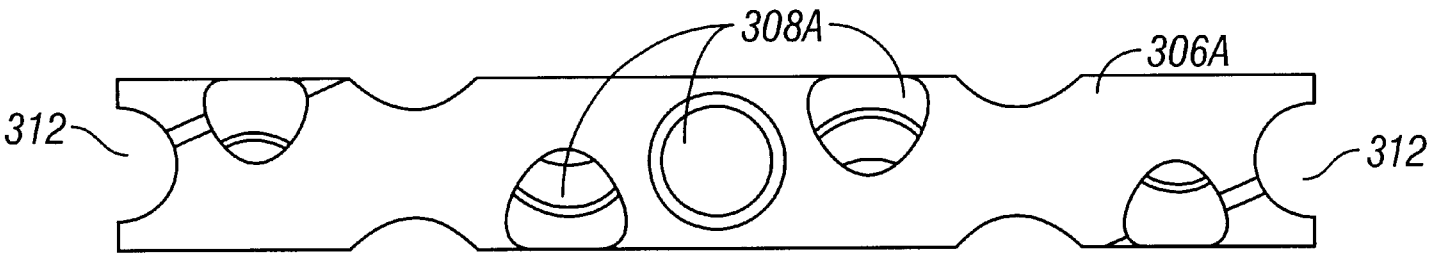
Figure 5C:
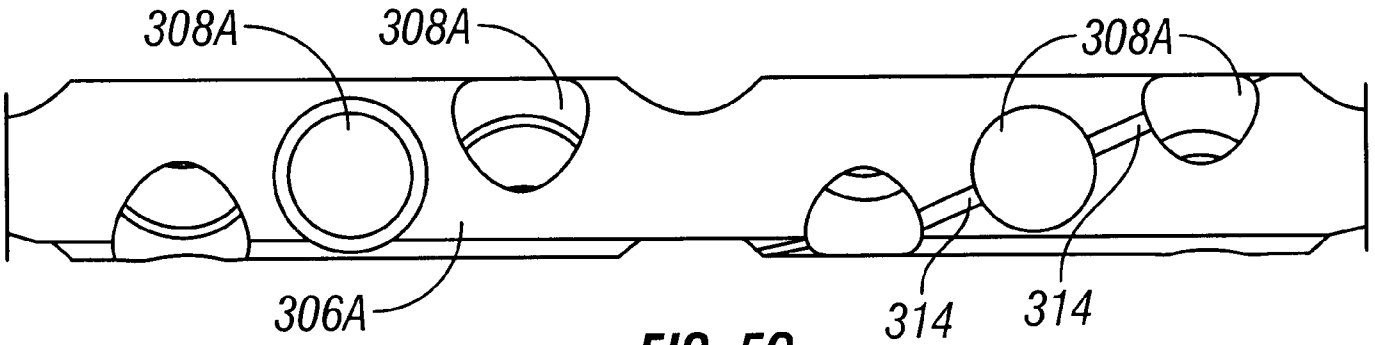
Figure 5D:
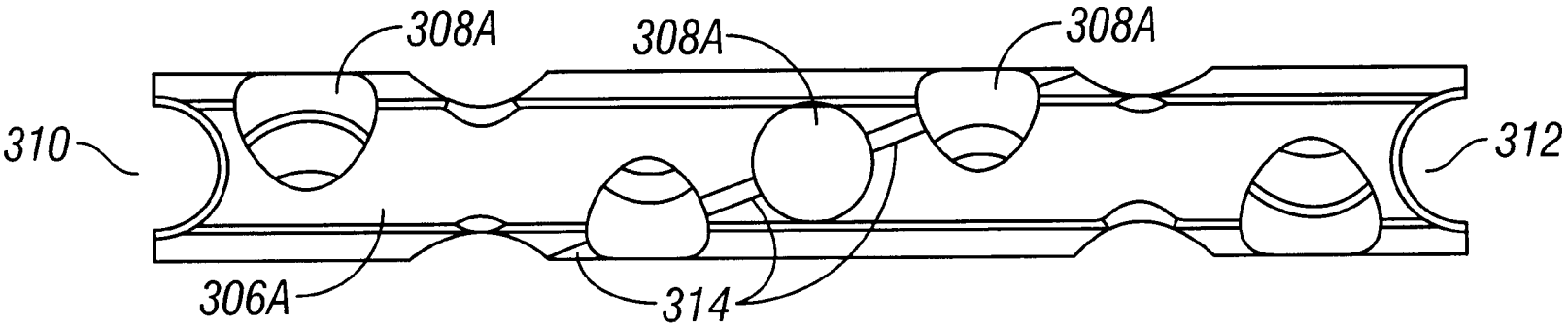

In FIGS. 5B–5D, in another embodiment, instead of a hollow tube 306, a solid bar 306A with cavities 308A (for the shaped charges) is used instead. FIGS. 5B–5D show three views of three different portions of the bar 306A without the charges mounted therein. The bar 306A can be made of a porous material, such as porous solid. As shown in FIGS. 5B and 5D, first and second grooves 310 and 312 are formed at the ends of the bar 306A to receive the 0°-phased shaped charges 304. Slots 314 are also formed on the outside surface of the bar 306A between the openings 308A to receive a detonating cord that is ballistically coupled to each of the shaped charges in the bar 306A.

To further enhance the underbalance effect, a greater amount of the porous solid can be provided around each gun. For example, a cylindrical block of the porous solid can have a maximum diameter that is slightly smaller than the smallest restriction (e.g., production tubing string) that the gun has to pass through.

Alternatively, a porous slurry can be pumped down and around the gun; in such a scenario, the restriction on size is not a limitation on how much porous material can be placed around the gun. Thus, for example, in FIG. 1, the area 54 around the gun 56 is filled with the porous slurry pumped down the tubing 52 and around the gun system 56.

Other embodiments of increasing transient pressure drops, and thus transient underbalance conditions, are described below. In one such other embodiment, a sealed atmospheric container is lowered into the wellbore after a formation has been perforated. After production is started, openings are created (such as by use of explosives, valves, or other mechanisms) in the housing of the container to generate a sudden underbalance condition or fluid surge to remove the damaged sand grains around the perforation tunnels and to remove loose debris.

In accordance with yet other embodiments, a tool string including multiple chambers and a perforating gun is lowered into the wellbore. In these other embodiments, a first chamber is used to create an underbalance condition prior to perforating. The perforating gun is then fired, following which the perforating gun is released. After the perforating gun has dropped away from the perforated formation, a second chamber is opened to create a flow surge from the formation into the second chamber. After a surge of a predetermined volume of formation fluid into the second chamber, a flow control device may be opened to inject fluid in the second chamber back into the formation. Alternatively, the formation fluid in the second chamber may be produced to the surface.

In yet another embodiment, a chamber within the gun can be used as a sink for wellbore fluids to generate the underbalance condition. Following charge detonation, hot detonation gas fills the internal chamber of the gun. If the resultant detonation gas pressure is less than the wellbore pressure, then the cooler wellbore fluids are sucked into the gun housing. The rapid acceleration through perforation ports in the gun housing breaks the fluid up into droplets and results in rapid cooling of the gas. Hence, rapid gun pressure loss and even more rapid wellbore fluid drainage occurs, which generates a drop in the wellbore pressure. The drop in wellbore pressure creates an underbalance condition.

Figure 8:
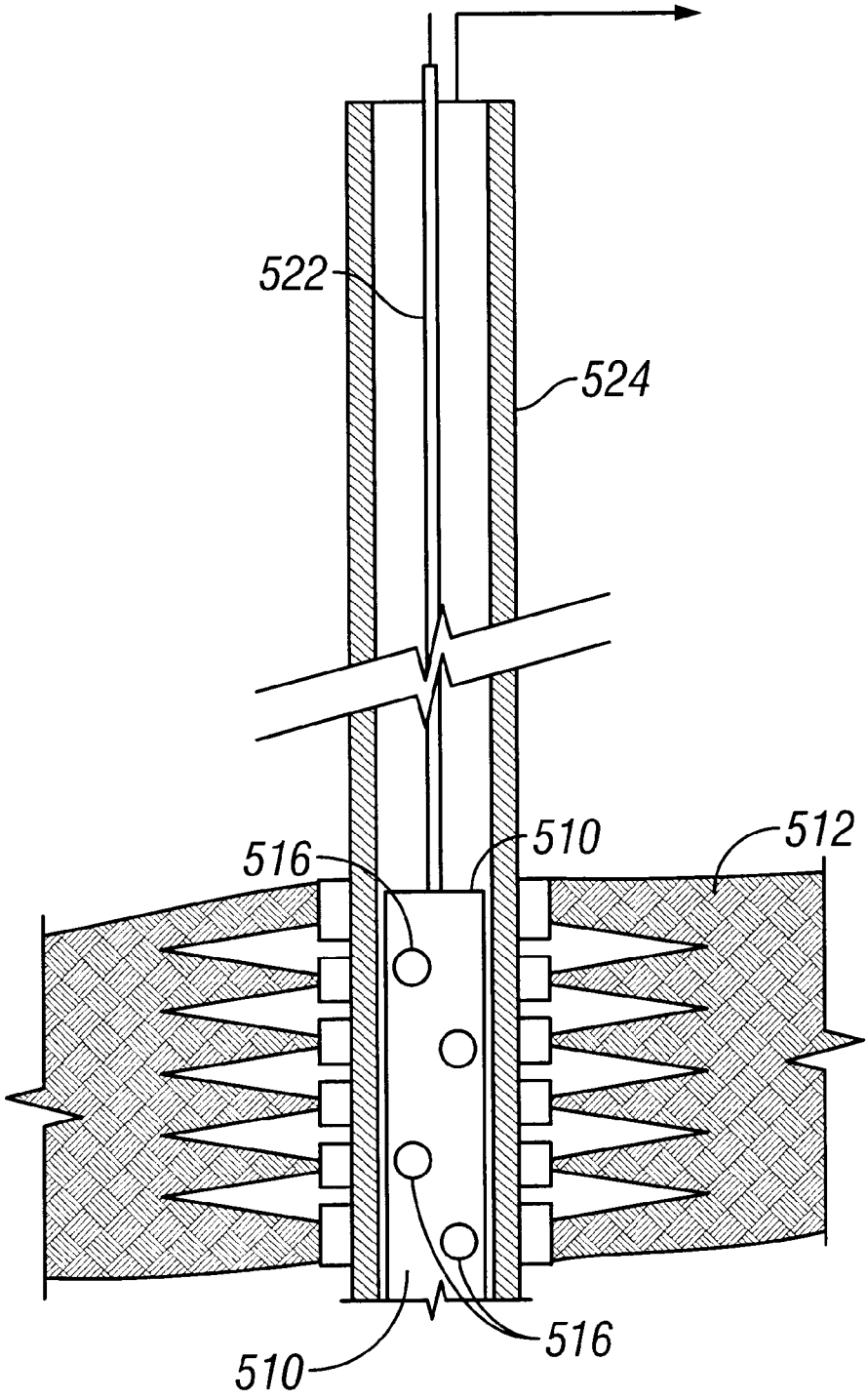
FIGS. 8–11 illustrate gun systems according to other embodiments for enhancing a transient underbalance.

Referring to FIG. 8, a tool string having a sealed atmospheric container 510 (or container having an inner pressure that is lower than an expected pressure in the wellbore in the interval of the formation 512) is lowered into a wellbore (which is lined with casing 524) and placed adjacent a perforated formation 512 to be treated. The tool string is lowered on a carrier line 522 (e.g., wireline, slickline, coiled tubing, etc.). The container 510 includes a chamber that is filled with a gas (e.g., air, nitrogen) or other fluid. The container 510 has a sufficient length to treat the entire formation 512 and has multiple ports 16 that can be opened up using explosives.

In one embodiment, while the well is producing (after perforations in the formation 512 have been formed), the atmospheric chamber in the container 510 is explosively opened to the wellbore. This technique can be used with or without a perforating gun. When used with a gun, the atmospheric container allows the application of a dynamic underbalance even if the wellbore fluid is in overbalance just prior to perforating. The atmospheric container 510 may also be used after perforation operations have been performed. In this latter arrangement, production is established from the formation, with the ports 516 of the atmospheric container 510 explosively opened to create a sudden underbalance condition.

The explosively actuated container 510 in accordance with one embodiment includes air (or some other suitable gas or fluid) inside. The dimensions of the chamber 510 are such that it can be lowered into a completed well either by wireline, coiled tubing, or other mechanisms. The wall thickness of the chamber is designed to withstand the downhole wellbore pressures and temperatures. The length of the chamber is determined by the thickness of perforated formation being treated. Multiple ports 516 may be present along the wall of the chamber 510. Explosives are placed inside the atmospheric container in the proximity of the ports.

In one arrangement, the tool string including the container 510 is lowered into the wellbore and placed adjacent the perforated formation 512. In this arrangement, the formation 512 has already been perforated, and the atmospheric chamber 510 is used as a surge generating device to generate a sudden underbalance condition. Prior to lowering the atmospheric container, a clean completion fluid may optionally be injected into the formation. The completion fluid is chosen based on the formation wettability, and the fluid properties of the formation fluid. This may help in removing particulates from the perforation tunnels during fluid flow.

After the atmospheric container 510 is lowered and placed adjacent the perforated formation 512, the formation 512 is flowed by opening a production valve at the surface. While the formation is flowing, the explosives are set off inside the atmospheric container, opening the ports of the container 510 to the wellbore pressure. The shock wave generated by the explosives may provide the force for freeing the particles. The sudden drop in pressure inside the wellbore may cause the fluid from the formation to rush into the empty space left in the wellbore by the atmospheric container 510.

This fluid carries the mobilized particles into the wellbore, leaving clean formation tunnels. The chamber may be dropped into the well or pulled to the surface.

Figure 9:
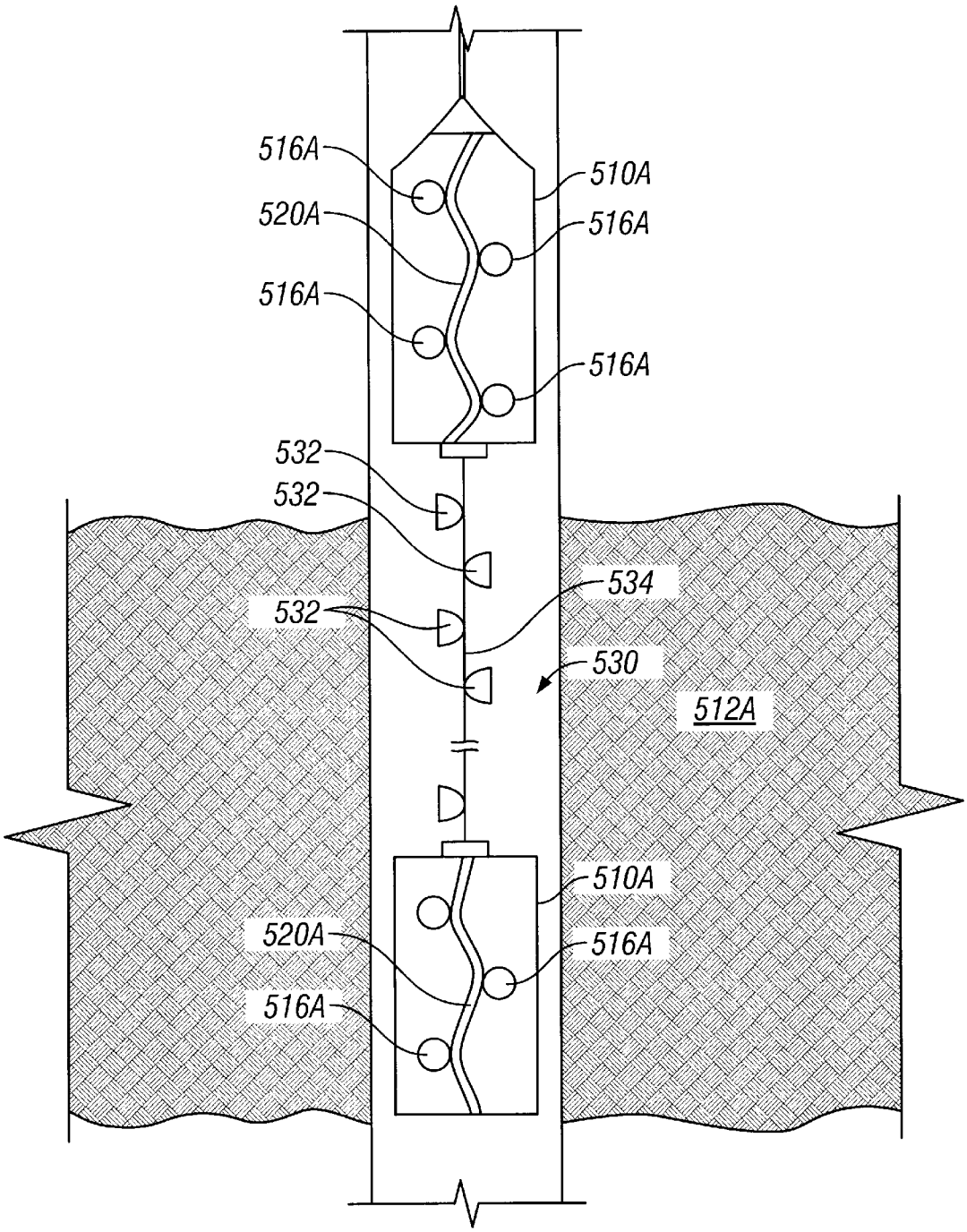

If used with a perforating gun, activation of the perforating gun may substantially coincide with opening of the ports 516. This provides underbalanced perforation. Referring to FIG. 9, use of an atmospheric container 510A in conjunction with a perforating gun 530, in accordance with another embodiment, is illustrated. In the embodiment of FIG. 9, the container 510A is divided into two portions, a first portion above the perforating gun 530 and a second portion below the perforating gun 530. The container 510A includes various openings 516A that are adapted to be opened by an explosive force, such as an explosive force due to initiation of a detonating cord 520A or detonation of explosives connected to the detonating cord 520A. The detonating cord is also connected to shaped charges 532 in the perforating gun 530. In one embodiment, as illustrated, the perforating gun 530 can be a strip gun, in which capsule shaped charges are mounted on a carrier 534. Alternatively, the shaped charges 532 may be non-capsule shaped charges that are contained in a sealed container.

The fluid surge can be performed relatively soon after perforating. For example, the fluid surge can be performed within about one minute after perforating. In other embodiments, the pressure surge can be performed within (less than or equal to) about 10 seconds, one second, or 100 milliseconds, as examples, after perforating. The relative timing between perforation and fluid flow surge is applicable also to other embodiments described herein.

Figure 10:
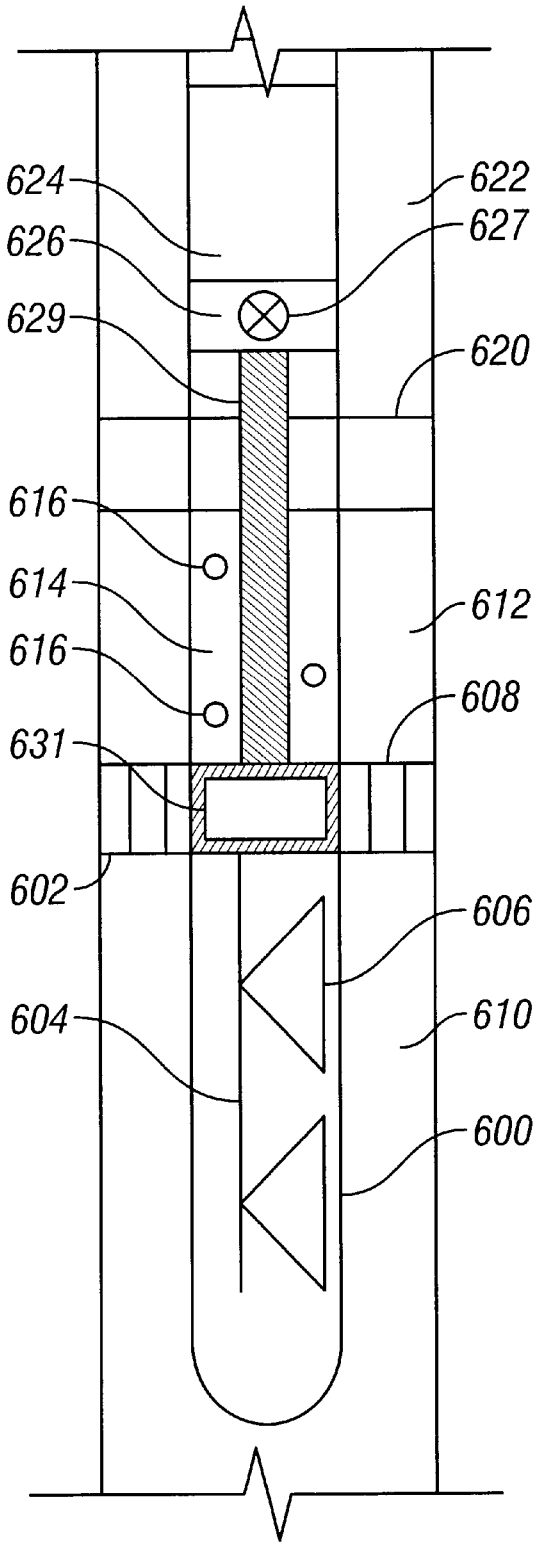

Referring to FIG. 10, in accordance with another embodiment, a tool string with plural chambers may be employed. The tool string includes a perforating gun 600 that is attached to an anchor 602. The anchor 602 may be explosively actuated to release the perforating gun 600. Thus, for example, activation of a detonating cord 604 to fire shaped charges 606 in the perforating gun 600 will also actuate the anchor 602 to release the perforating gun 600, which will then drop to the bottom of the wellbore.

The anchor 602 includes an annular conduit 608 to enable fluid communication in the annulus region 610 (also referred to as a rat hole) with a region outside a first chamber 614 of the tool string. The first chamber 614 has a predetermined volume of gas or fluid. The housing defining the first chamber 614 may include ports 616 that can be opened, either explosively or otherwise. The volume of the first chamber 614 in one example may be approximately 7 liters or 2 gallons. This is provided to achieve roughly a 200 psi (pounds per square inch) underbalance condition in the annulus region 610 when the ports 616 are opened. In other configurations, other sizes of the chamber 614 may be used to achieve a desired underbalance condition that is based on the geometry of the wellbore and the formation pressure. A control module 626 may include a firing head (or other activating mechanism) to initiate a detonating cord 629 (or to activate some other mechanism) to open the ports 616.

A packer 620 is set around the tool string to isolate the region 612 from an upper annulus region 622 above the packer 620. Use of the packer 620 provides isolation of the rat hole so that a quicker response for the underbalance condition or surge can be achieved. However, in other embodiments, the packer 620 may be omitted. Generally, in the various embodiments described herein, use of a packer for isolation or not of the annulus region is optional.

The tool string of FIG. 10 also includes a second chamber 124. The control module 126 may also include a flow control device 127 (e.g., a valve) to control communication of well fluids from the first chamber 114 to the second chamber 124. During creation of the underbalance condition, the flow control device 127 is closed.

Figure 11:
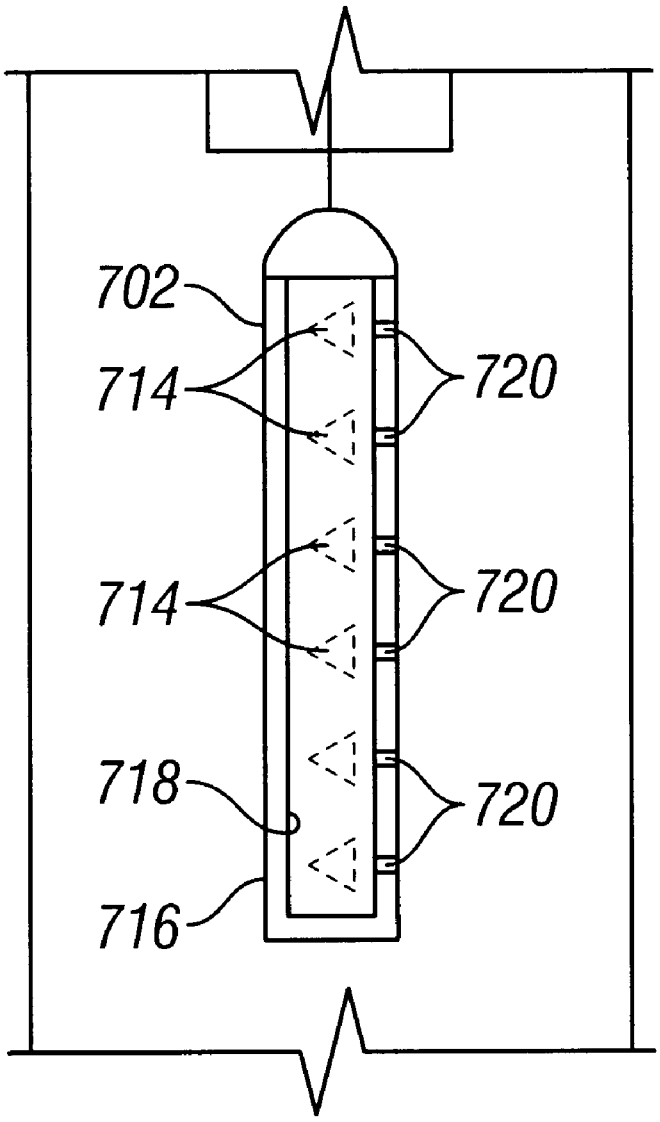

Referring to FIG. 11, yet another embodiment for creating an underbalance condition during a perforating operation is illustrated. A perforating gun string 700 includes a perforating gun 702 and a carrier line 704, which can be a slickline, a wireline, or coiled tubing. In one embodiment, the perforating gun 702 is a hollow carrier gun having shaped charges 714 inside a chamber 718 of a sealed housing 716. In the arrangement of FIG. 11, the perforating gun 702 is lowered through a tubing 706. A packer 710 is provided around the tubing 706 to isolate the interval 712 in which the perforating gun 702 is to be shot (referred to as the "perforating interval 712"). A pressure $P_W$ is present in the perforating interval 712.

Referring to FIG. 11, during detonation of the shaped charges 714, perforating ports 720 are formed as a result of perforating jets produced by the shaped charges 714. During detonation of the shaped charges 714, hot gas fills the internal chamber 718 of the gun 716. If the resultant detonation gas pressure, $P_G$, is less than the wellbore pressure, $P_W$, by a given amount, then the cooler wellbore fluids will be sucked into the chamber 718 of the gun 702. The rapid acceleration of well fluids through the perforation ports 720 will break the fluid up into droplets, which results in rapid cooling of the gas within the chamber 718. The resultant rapid gun pressure loss and even more rapid wellbore fluid drainage into the chamber 718 causes the wellbore pressure $P_W$ to be reduced. Depending on the absolute pressures, this pressure drop can be sufficient to generate a relatively large underbalance condition (e.g., greater than 2000 psi), even in a well that starts with a substantial overbalance (e.g., about 500 psi). The underbalance condition is dependent upon the level of the detonation gas pressure $P_G$, as compared to the wellbore pressure, $P_W$.

When a perforating gun is fired, the detonation gas is substantially hotter than the wellbore fluid. If cold wellbore fluids that are sucked into the gun produce rapid cooling of the hot gas, then the gas volume will shrink relatively rapidly, which reduces the pressure to encourage even more wellbore fluids to be sucked into the gun. The gas cooling can occur over a period of a few milliseconds, in one example. Draining wellbore liquids (which have small compressibility) out of the perforating interval 712 can drop the wellbore pressure, $P_W$, by a relatively large amount (several thousands of psi).

In accordance with some embodiments, various parameters are controlled to achieve the desired difference in values between the two pressures $P_W$ and $P_G$. For example, the level of the detonation gas pressure, $P_G$, can be adjusted by the explosive loading or by adjusting the volume of the chamber 718. The level of wellbore pressure, $P_W$, can be adjusted by pumping up the entire well or an isolated section of the well, or by dynamically increasing the wellbore pressure on a local level.

Figure 6:
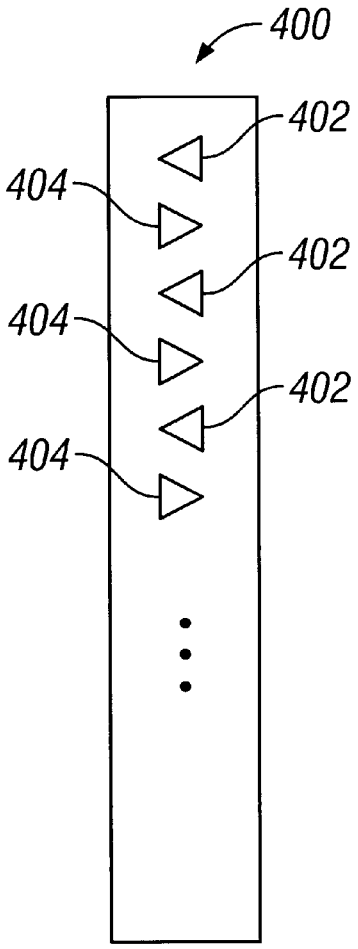
FIGS. 6 and 7 illustrate gun strings for reducing transient underbalance in a perforating interval.
Figure 7:
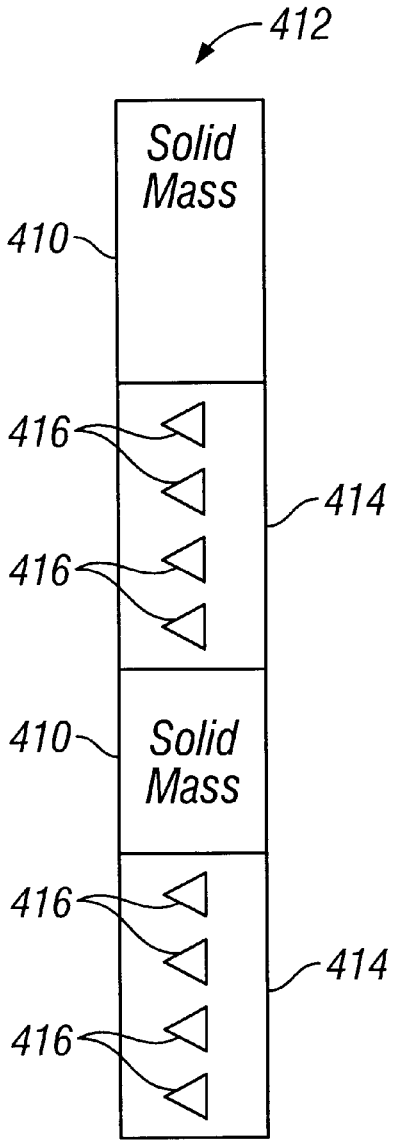

The above describes examples of assemblies that enhance or increase transient underbalance conditions. On the other hand, the embodiments shown in FIGS. 6 and 7 involve assemblies that reduce (rather than increase) transient underbalance conditions. Reducing the local underbalance condition may be desirable when perforating a high-pressure reservoir (such as those with pressures greater than about 9–10 kpsi). As shown in FIG. 6, an example perforating gun 400 that is configured to reduce a local transient underbalance condition is illustrated.

The gun includes a plurality of live shaped charges 402, as well as one or more dummy chargers 404. When detonated, a shaped charge generates a gas that may be at a lower pressure than the surrounding wellbore, particularly in a well environment adjacent a high-pressure reservoir. To reduce the local pressure drop upon gun detonation, a smaller number of shaped charges are used (effectively reducing the shot density). This can be accomplished by replacing live shaped charges with dummy charges or weights each formed of a solid mass.

In effect, in some cases, to reduce the local transient underbalance, the number of charges used is less than the number of charges that a perforating gun can handle when loaded to its maximum capacity. Instead of dummy charges 404, other types of solid masses or weights can be used in other embodiments.

The number of charges to use in the gun depends on various factors, including the target local transient underbalance condition that is desired by the well operator. Based on the known reservoir pressure and target local transient underbalance, the number of live shaped charges 402 to use in the gun is selected. The gun is then lowered into the wellbore and fired to perform the perforating operation.

Alternatively, or in addition to reducing shot density, the transient underbalance is reduced by reducing the total explosive mass of charges in the perforating gun. For example, charges with reduced explosive mass that is less than the maximum explosive mass the gun is designed for can be used.

Alternatively, instead of using dummy chargers or weights 404 to replace live shaped charges, solid masses 410 (e.g., solid bars, solid loading tubes, etc.) can be used as spacers along the length of a gun string 412. The solid masses 410 are positioned between guns 414 that each contains shaped charges 416. The solid masses 410 also effectively reduce the number of shaped charges that are detonated gun observation of the gun string 412. As a result, the amount of gas produced due to charge detonation is decreased, which reduces the local transient pressure drop.

Instead of using solid masses 410, other types of materials can also be used. As examples, sand, concrete, or other filler material can be used to fill in empty portions of perforating guns in a string. This can further reduce the transient underbalance condition that occurs as a result of activation of the perforating guns. By reducing transient underbalance, the post-perforating surge is reduced. This is especially helpful for reservoirs that are in a weak formation. Reducing the dynamic underbalance condition reduces the amount of sand that is produced into the wellbore as a result of the activation of the perforating gun string.

As noted above, for well control, the perforating operation is performed in a well maintained at a pressure to achieve an overbalance condition. However, a concern associated with this condition is the effect of a transient overbalance applied to the perforating interval following the transient underbalance created by activation of a perforating gun in the perforating interval. In other words, the wellbore is initially in an overbalance condition. Using various embodiments of the invention, a gun string when activated causes a local transient underbalance in the perforating interval for clearing perforation tunnels in the formation. However, as a result of the gun activation, additional space is created in the gun such that well fluids rush into the space. This causes a transient overbalance condition to be generated in the perforating interval following generation of the transient underbalance.

The transient overbalance condition after gun activation may cause damage to the perforation tunnels in the formation that have just been cleaned. In accordance with some embodiments of the invention, a mechanism is provided to reduce this transient overbalance following gun activation.

Figure 12:
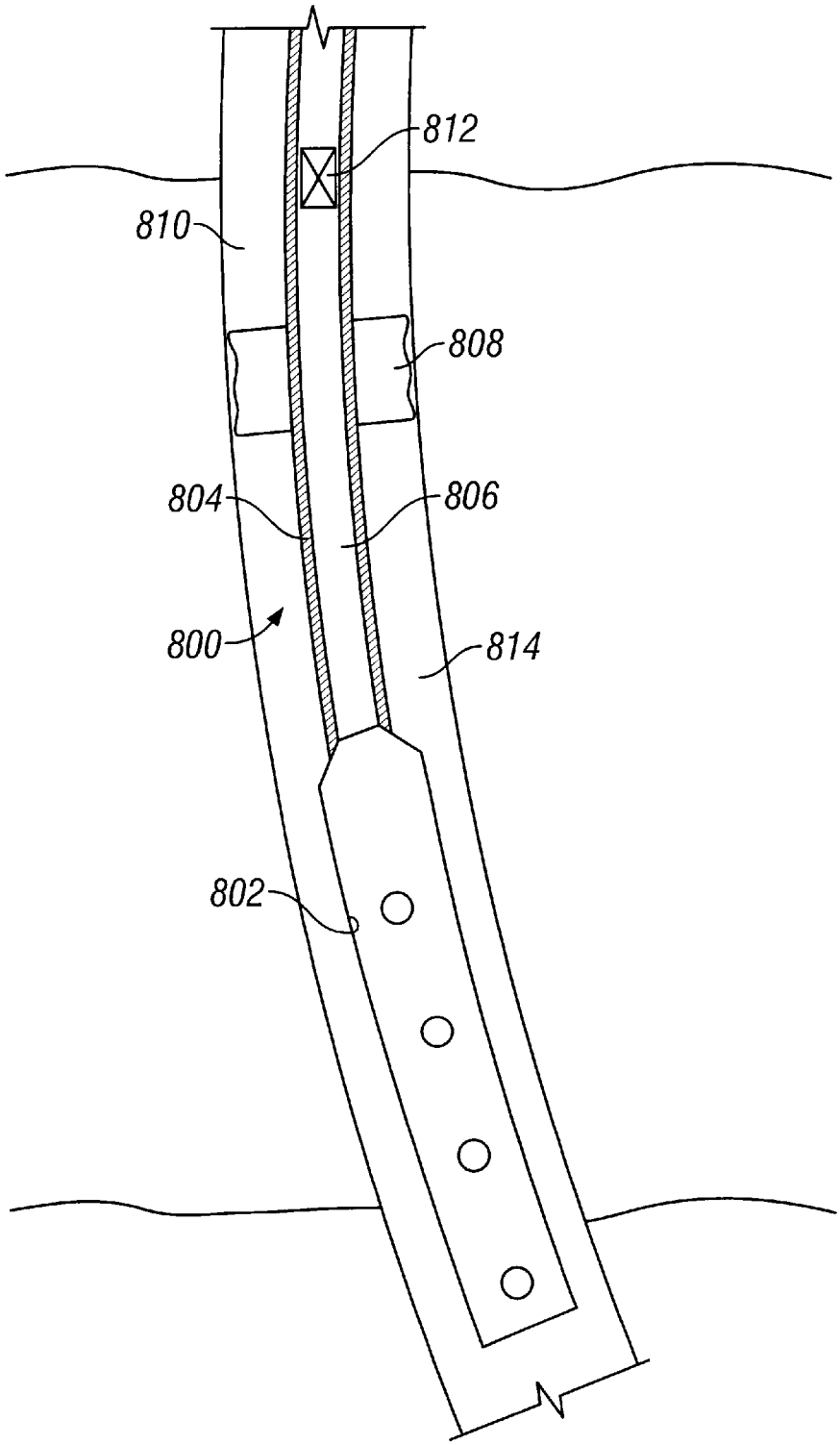
FIGS. 12 and 13 illustrate gun systems for reducing effects of a transient overbalance in a perforating interval.

FIG. 12 illustrates one embodiment of this mechanism. A perforating gun string 800 includes a perforating gun 802 and a tubing 804 that carries the perforating gun 802 into the wellbore. The tubing 804 can be coiled tubing or any other type of tubing or pipe. The tubing 804 includes an inner longitudinal bore 806 that enables the passage of well fluids. When the wellbore is in the initial overbalance condition, the entire length of the tubing bore 806 also contains fluid at the overbalance pressure. This is true also of the pressure in the annulus 810 surrounding the tubing 804.

Normally, when the gun 802 is fired and a transient underbalance condition is created as a result of the gun activation, the transient underbalance condition acts to draw debris out of the perforation tunnels in the surrounding formation. However, right after this, all the pressure in the tubing 804 and the annulus 810 is communicated to the extra space created as a result of gun activation. The extra space results from the detonation of explosives, such as shaped charges, inside the perforating gun 802.

Because the fluid inside the tubing 804 and in the annulus 810 is at a pressure that is greater than the formation pressure (to provide the overbalance condition), this higher pressure surges into the extra space created by activation of the perforating gun 802. As a result, a transient overbalance is created, which may damage the surrounding formation.

To reduce this transient overbalance, a choke device (or some other type of flow control device) 812 is placed in the bore 806 of the tubing 804. This choke device 812 limits the flow rate of fluid inside the tubing 804. Also, a packer 808 is placed around the outside of the tubing 804 to provide a seal so that the overbalance pressure in the annulus 810 is isolated from the perforating interval 814.

By limiting the flow rate inside the tubing 804 with the choke device 812, the rate at which pressure increases in the perforating interval 814 from communication of fluid above the choke device 812 into the perforating gun 802 is reduced. This slows down the rate at which pressure increases in the perforating interval 814. The net effect is that the perforating interval 814 will increase to the overbalance pressure, but at a slower rate. This reduces the surge of pressure into the perforating interval 814, thereby reducing the likelihood of damage to the perforations formed in the surrounding formation.

In an alternative embodiment, the packer 808 is replaced with some other type of sealing element. The sealing element does not need to completely seal the annulus region 810. In fact, the sealing element that replaces the packer 808 can be a "leaky" packer, such as an inflatable packer that does not provide a complete seal between the packer and the inner wall of the wellbore (or casing). Although the leaky packer (or alternatively, a leaky anchor) allows the flow of fluid from the annulus 810 into the perforating interval 814, this flow occurs at a much slower rate than if the leaky packer or leaky anchor were not present. Therefore, the goal of reducing the rate at which the pressure in the perforating interval reaches the overbalance condition is reduced by the combination of the leaky packer (or leaky anchor) and the choke device 810.

Figure 13:
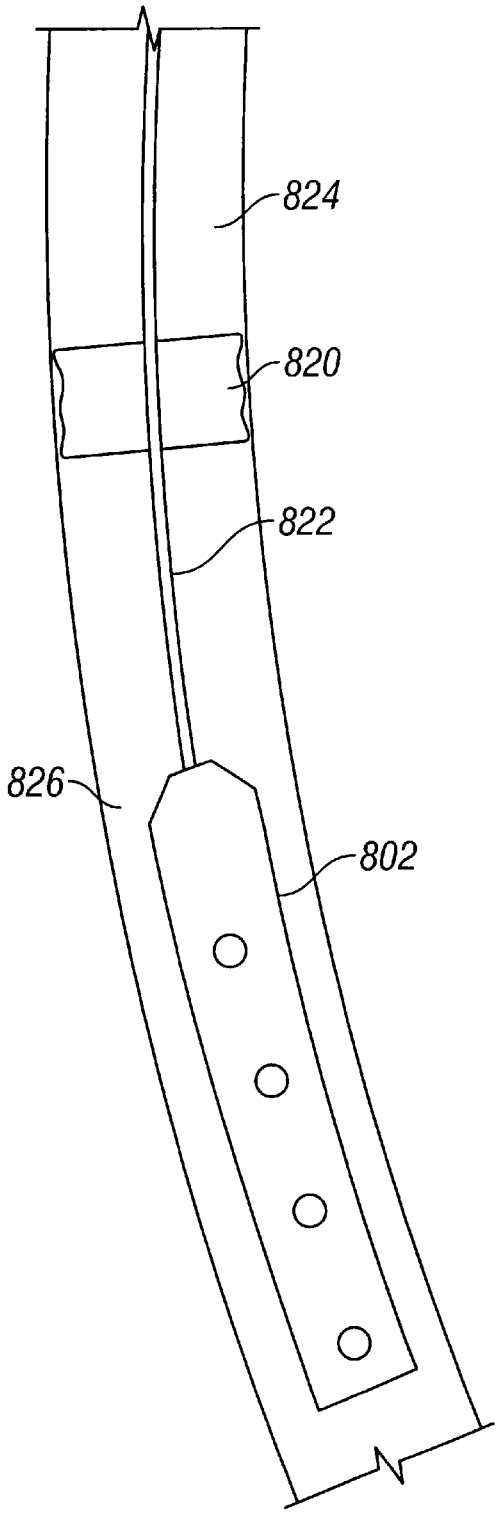

In yet another embodiment, as shown in FIG. 13, instead of a tubing 804, the perforating gun 802 is carried by a wireline, slickline, or other type of carrier 822 in which an internal bore for communication of fluid does not exist. In such an alternative embodiment, the choke device 812 is not used. Rather, as shown in FIG. 13, a leaky packer or leaky anchor 820 is provided around the wireline, slickline, or other carrier 822. The leaky packer or leaky anchor serves to reduce the rate at which pressure in an annulus 824 is communicated to the perforating interval 826.

Instead of perforating guns, other embodiments can employ other types of devices that contain explosive components. Use of solid masses, weights, or dummy explosives can also reduce local transient pressure drops due to explosive detonation of such other types of devices.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A method of controlling an underbalance condition in a wellbore, comprising:

configuring a perforating gun string according to a target transient underbalance condition in a perforating interval;

generating substantially the target transient underbalance condition in the perforating interval of the wellbore when the perforating gun string is shot; and determining the target transient underbalance condition based on one or more predetermined criteria.

2. The method of claim 1, further comprising determining a configuration of the perforating gun string based on the target transient underbalance condition.

3. The method of claim 1, wherein generating substantially the target transient underbalance condition comprises temporarily providing a temporary pressure less than a reservoir pressure in the perforating interval.

4. A method of controlling an underbalance condition in a wellbore, comprising:

configuring a perforating gun string according to a target transient underbalance condition in a perforating interval; and generating substantially the target transient underbalance condition in the perforating interval of the wellbore when the perforating gun string is shot, wherein configuring the perforating gun string comprises reducing a total explosive mass by using charges with reduced explosive mass that is less than a maximum explosive mass for which the perforating gun string is designed.

5. The method of claim 4, wherein configuring the perforating gun string further comprises reducing shot density.

6. A method of controlling an underbalance condition in a wellbore, comprising:

configuring a perforating gun string according to a target transient underbalance condition in a perforating interval; and generating substantially the target transient underbalance condition in the perforating interval of the wellbore when the perforating gun string is shot, wherein configuring the perforating gun string comprises reducing a shot density of the perforating gun string.

7. The method of claim 6, wherein reducing the shot density comprises replacing live explosives with solid masses.

8. The method of claim 6, wherein reducing the shot density comprises providing extended solid masses between gun sections to reduce the shot density of the perforating gun string.

9. A method of controlling an underbalance condition in a wellbore, comprising:

configuring a perforating gun string according to a target transient underbalance condition in a perforating interval; and generating substantially the target transient underbalance condition in the perforating interval of the wellbore when the perforating gun string is shot; and providing a porous solid proximate at least a portion of the perforating gun string, the porous solid having an initially sealed volume to receive wellbore fluids in response to detonation of the perforating gun string.

10. The method of claim 9, wherein providing the porous solid comprises providing a solid having hollow structures filled with an element selected from the group consisting of a gas, vacuum, and liquid.

11. The method of claim 10, wherein providing the hollow structures comprises providing one of gas-filled microspheres and vacuum-filled microspheres.

12. The method of claim 9, wherein providing the porous solid comprises providing porous cement.

13. An apparatus comprising:

a tool containing explosives; and an amount of porous solid provided around the tool to provide an initially sealed volume to receive wellbore fluids in response to detonation of the explosives, the amount of porous solid based on a target transient underbalance condition in a wellbore interval.

14. The apparatus of claim 13, wherein the porous solid is positioned to be shattered in response to detonation of the explosive, the shattering of the porous solid enabling the wellbore fluid to enter the initially sealed volume.

15. The apparatus of claim 14, wherein the porous solid comprises porous cement.

16. The apparatus of claim 14, wherein the porous solid contains hollow structures each being either gas filled or vacuum filled.

17. The apparatus of claim 14, wherein the porous solid contains gas-filled or vacuum-filled microspheres.

18. A method for use in a wellbore, comprising:

determining a target transient underbalance condition in a wellbore interval;

lowering a tool having explosives to the wellbore interval;

providing a porous solid proximate the explosives, the porous solid having an initially sealed volume;

detonating the explosives; and shattering the porous solid and exposing the sealed volume of the porous solid to increase the effective volume of the wellbore interval to achieve substantially the target transient underbalance condition in the wellbore interval.

19. The method of claim 18, wherein increasing the effective volume of the wellbore interval causes the transient pressure in the wellbore interval to decrease.

20. The method of claim 18, wherein providing the porous solid having the initially sealed volume comprises providing the porous solid having one of gas-filled and vacuum-filled microspheres.

21. The method of claim 20, wherein providing the porous solid comprises providing porous cement.

22. A method for use in a wellbore, comprising:

determining a target transient underbalance condition;

lowering a tool containing explosives into the wellbore; and configuring a number of explosives in the tool based on the target transient underbalance condition such that, upon detonation of the explosives to the system achieves substantially the target transient underbalance condition.

23. The method of claim 22, wherein configuring the number of explosives comprises reducing a density of the explosives.

24. A perforating apparatus for use in a wellbore, comprising:

a carrier line;

a perforating gun; and a sealing device to control a rate of fluid flow from a first region of the wellbore to a second region of the wellbore proximate the perforating gun, the sealing device adapted to reduce a rate at which pressure increases to an overbalance condition in the second region, wherein the sealing device comprises one of a leaky packer and leaky anchor.

25. The perforating apparatus of claim 24, wherein the carrier line comprises a fluid conduit, the perforating apparatus further comprising a flow rate control device in the fluid conduit and the sealing device provided outside the fluid conduit.

26. The perforating apparatus of claim 24, further comprising another perforating gun.

27. A method of perforating in a wellbore, comprising:

providing a string having a carrier line and a perforating gun;

providing a sealing device to control a rate of fluid flow; and reducing, with the sealing device, a rate at which pressure increases to an overbalance condition in a perforating interval proximate the perforating gun, wherein providing the sealing device comprises providing one of a leaky packer and leaky anchor around the carrier line.

28. The method of claim 27, wherein the carrier line comprises a tubing, and wherein providing the sealing device further comprises providing a flow control element in a bore of the tubing.

* * * * *

UNITED STATES PATENT AND TRADEMARK OFFICE
Certificate

Patent No. 6,732,798 B2 Patented: May 11, 2004

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Ashley B. Johnson, Cambridge, Great Britain; Lawrence A. Behrmann, Houston, Texas; Wenbo Yang, Sugar Land, Texas; Fokko Harm Cornelis Doornbosch, Sola, Netherlands; and Ian C. Walton, Sugar Land, Texas.

Signed and Sealed this First Day of February 2005.

DAVID J. BAGNELL
*Supervisory Patent Examiner*
Art Unit 3672